United States Patent [19]

Ruyter

[11] 4,412,790

[45] Nov. 1, 1983

[54] BALANCED SUPPLEMENTAL WATER BLEED FOR SUCTION DREDGERS

[75] Inventor: Thomas J. Ruyter, Schagen, Netherlands

[73] Assignees: Ballast-Nedam Groep N.V.; Amsterdamse Ballast Bagger en Grond (Amsterdam Ballast Dredging) B.V., both of Amstelveen, Netherlands

[21] Appl. No.: 310,749

[22] Filed: Oct. 13, 1981

Related U.S. Application Data

[63] Continuation of Ser. No. 83,284, Oct. 10, 1979, abandoned.

[30] Foreign Application Priority Data

Nov. 3, 1978 [EP] European Pat. Off. ..... 78200287.7

[51] Int. Cl.[3] ..... F04B 49/10

[52] U.S. Cl. ..... 417/306

[58] Field of Search ..... 417/306, 295, 299

[56] References Cited

U.S. PATENT DOCUMENTS

| | | | |
|---|---|---|---|
| 974,286 | 11/1910 | Matchette et al. | 417/306 |
| 1,508,521 | 9/1924 | Kreusen | 37/58 |
| 2,572,263 | 10/1951 | Hofer | 417/279 X |
| 2,603,234 | 7/1952 | Hofer | 417/306 X |
| 2,889,779 | 6/1959 | Hofer | 417/306 X |
| 3,109,377 | 11/1963 | Hofer | 417/279 |
| 3,111,778 | 11/1963 | Fonnesbeck | 417/306 X |
| 3,180,040 | 4/1965 | Ballam | 37/59 |
| 3,263,615 | 8/1966 | Hofer | 417/279 |

FOREIGN PATENT DOCUMENTS

| | | | |
|---|---|---|---|
| 834117 | 8/1938 | France | 417/306 |
| 1299379 | 12/1972 | United Kingdom . | |

*Primary Examiner*—Richard E. Gluck

*Attorney, Agent, or Firm*—Diller, Ramik & Wight

[57] ABSTRACT

Method and device for safeguarding hydraulic transport of a suspension of dredging spoil and water by supplementing a dosed water amount onto the suction side of the pump, whereas as much and as long as possible suction power is maintained in the suction duct for feeding much material to be transported and little water into the suction duct.

4 Claims, 5 Drawing Figures

BALANCED SUPPLEMENTAL WATER BLEED FOR SUCTION DREDGERS

Figure 1:
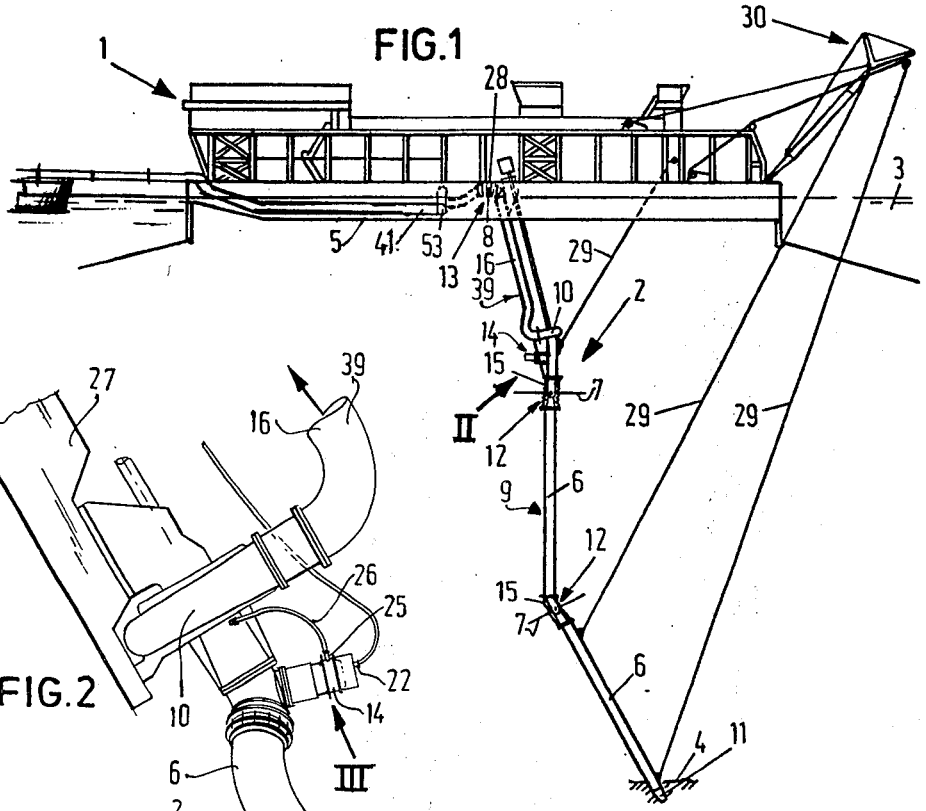

This application is a continuation, of application Ser. No. 83,284, filed Oct. 10, 1979, now abandoned.

The invention relates to a method of safeguarding transport of a suspension of dredging spoil and water through a hydraulic transport duct having an inlet for said suspension and including a pump and a water inlet between said suspension inlet and said pump. The water inlet is provided with a balanced closing member which operates in response to a pressure drop below a predetermined pressure on the suction side of the pump to supplement water flow into the transport duct and in response to an excess pressure above said predetermined pressure to terminate the supplemented water flow.

Such a method is known from U.S. Pat. No. 2,572,263 or U.S. Pat. No. 3,109,377. In these patents the closing members are automatically actuated through an electric switching mechanism which opens the closing member fully and as rapidly as possible when the dredger conduit becomes clogged, in order to avoid cavitation of the pump and thus to safeguard the fluid transport in the pressure duct. However, the result is that the suction power of the pump in the portion of the suction duct shortcircuited by the closing member is eliminated so that only water and no further material to be transported is fed into the transport duct. After the removal of the clogging or the obviation of the overload of the transport duct, the closing member is again fully closed and after the re-establishment of the suction power in the suction duct, the introduction of material to be transported can be resumed.

The invention has for its object to safeguard on the one hand the fluid transport and on the other hand to maintain as much and as long as possible the suction power in the suction duct in order to introduce much material to be transported and little water into the transport duct. According to the invention this is achieved by counteracting the source of power in order to move the closing member into the closed position by a pressure admitted into a pressure chamber and prevailing on the suction side of the pump and by enlarging or reducing the passage of the closing member accordingly as the pressure on the suction side of the pump becomes lower or higher respectively.

From U.S. Pat. No. 3,180,040 and U.S. Pat. No. 3,111,778 it is known per se to supplement dosed water near the suction nozzle into the suction duct by means of a hydraulically actuable, non-balanced slide in accordance with the pressure on the pressure side of the pump. This has the disadvantage that the closing member is not opened until an impermissible low pressure become manifest in the pressure duct, that is to say, when the pump is already cavitating.

U.S. Pat. No. 3,263,615 discloses a dredger in which a valve for supplementation of water is controlled by a control member incorporating a pressure difference measuring element, which measures the pressure difference in the suction line of the dredger. Such control member reacts dependently upon the flow resistance between the two connection points of the measuring element at the suction line. This measuring element, however, does not constitute such good information about the operational conditions of the pump as the pressure at the suction side of the pump does. The control member opens the valve for supplementation of water in case an electric contact is closed. Otherwise it does not. This control member does not operate gradually.

In order to avoid rapid reciprocation of the closing member, the movements of the closing member are preferably damped.

The invention relates to and provides a device for carrying out the method according to the invention comprising a hydraulic transport duct forming part of a dredging device comprising a pump, a pressure duct and a suction duct having a suspension inlet, a closing member included in the suction duct between said pump and said suspension inlet, said closing member being compelled into the open position by the action of a source of power for supplementing water into the suction duct and comprising driving means controlled by the pressure on the suction side of the pump for moving the closing member into the closed position against the source of power. This device is characterized in that the suction duct communicates with a pressure chamber bounded by a movable wall subjected to a source of power counteracting the pressure in the pressure chamber and being mechanically coupled with the closing member.

A particularly well balanced closing member is formed by a cylindrical slide.

It is noted that valve members constituted by a cylindrical slide are known per se, e.g. from U.S. Pat. No. 1,508,521 and French Pat. No. 2,198,558.

French Pat. No. 2,107,306 discloses a transport duct for transporting a suspension of dredging spoil and water, in which a relief valve for supplementing water is not arranged between a suspension inlet and the pump of said duct, but at the pressure side of said pump. The closing member consists of a cylindrical sheet of rubber which opens by being folded due to some extreme low pressure in the duct. This sheet folds back by its own elasticity into its cylindrical position not until the pressure in the duct is much higher than said extreme low pressure. This closing member is not able to gradually control the supplementation of water.

The source of power preferably comprises a pneumatic spring.

In order to continue the fluid transport at a failure of the automatic actuating means including the pressure chamber, the device according to the invention preferably comprises an additive, hydraulic motor for closing the closing member.

U.K. Pat. No. 1,299,379 discloses a dredger having a relief valve for supplementation of water into the suction line. The method of controlling said relief valve is not disclosed in the latter patent specification.

The invention will be described more fully hereinafter with reference to a drawing.

Figure 2:
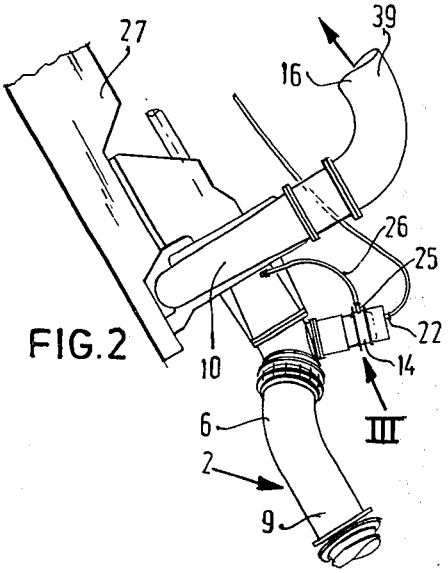
Figure 3:
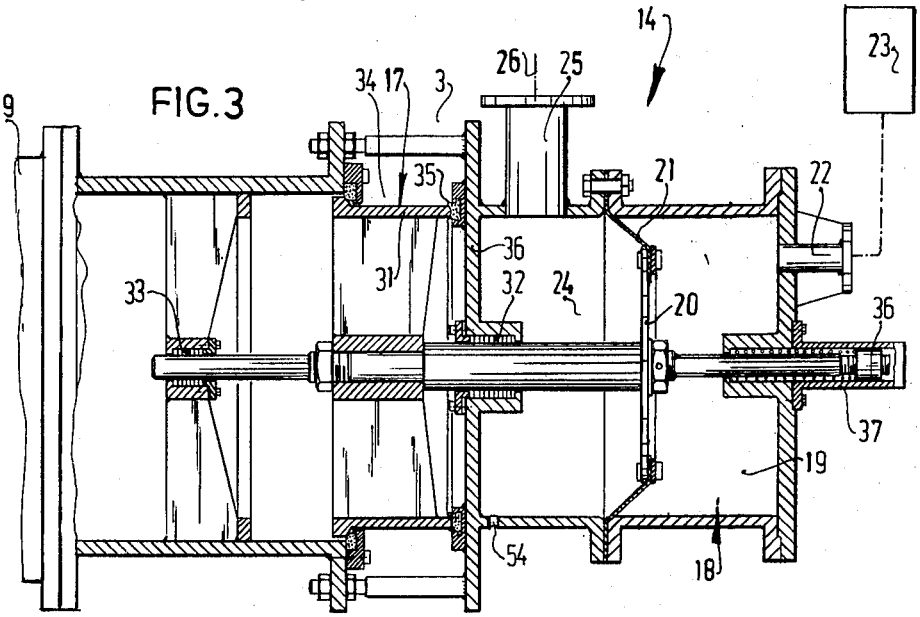
Figure 4:
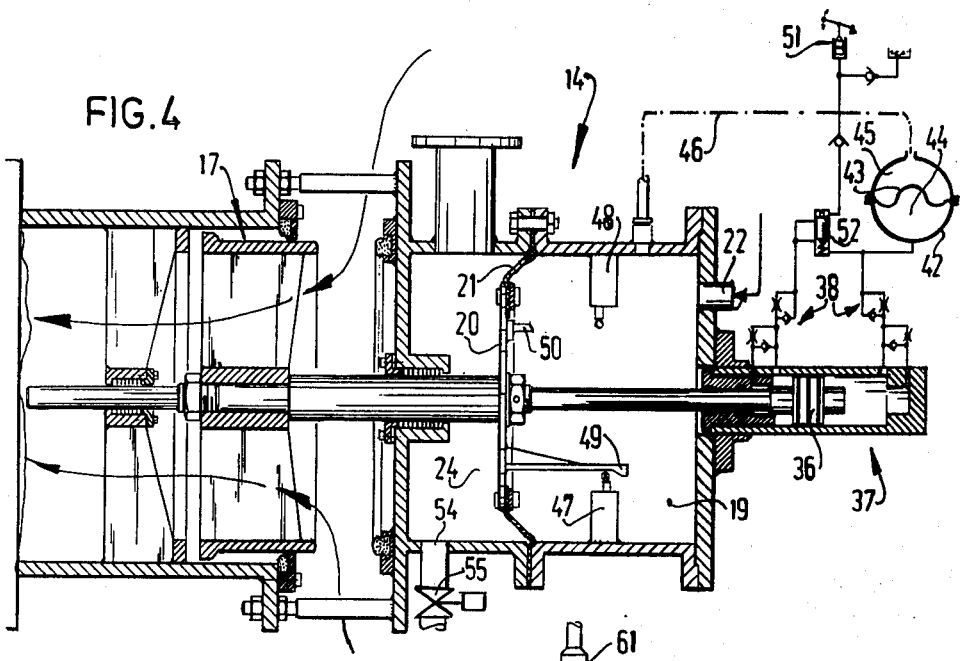
Figure 5:
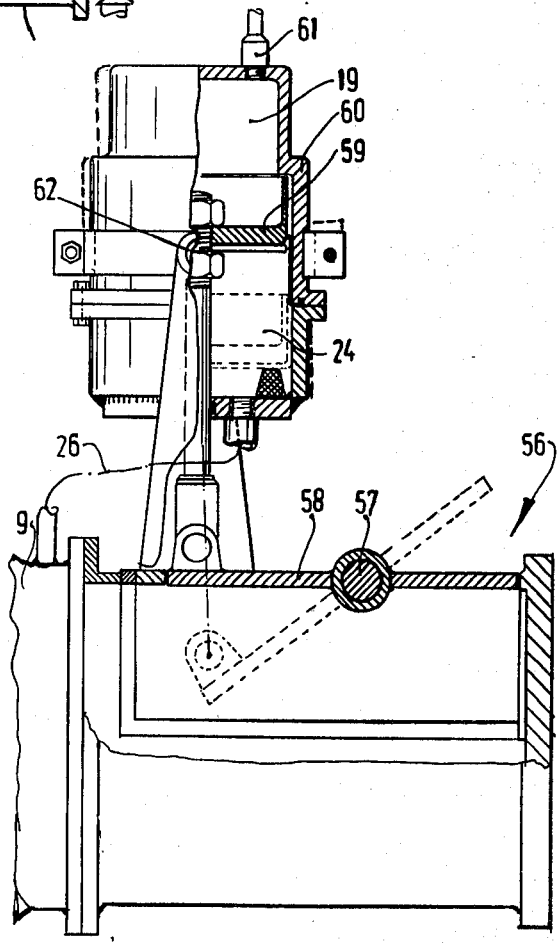

The drawing shows in:

FIG. 1 a side elevation of a device embodying the invention in the form of a ground dredger having a transport duct, FIG. 2 is an enlarged scale of section II of FIG. 1, FIG. 3 is an enlarged view of section III in FIG. 2; and FIGS. 4 and 5 each shows a partial view of a detail corresponding to FIG. 3 of a further development of the device embodying the invention.

The ground dredger 1 of FIG. 1 comprises a vessel 5 and a hydraulic transport duct 2 suspended therefrom for sucking up ground from a bottom 4 below the water 3. This transport duct 2 mainly consists of a pump 10, a pressure duct 39 and a suction duct 9 and a closing member 14. The transport duct 2 comprises the two rigid lengths of tubing 6 of the suction duct 9 and a rigid length of tubing 16 of the pressure duct 39. The tubing lengths 6 are pivoted to one another about the axis 7 by means of one hinge 12 whereas the tubing length 16 is pivoted to one of the lengths 6 by means of another hinge 12. The length of tubing 16 is pivoted to the vessel 5 by means of a hinge 13 about a pivotal axis 8. The suction duct 9 has a nozzle 11 to be inserted into the bottom 4, through which a suspension of ground and water is sucked into the transport duct 2. The tubings 6 and 16 communicate with one another at the area of the hinges 12 through bellows 15. The pump 10 together with the upper tubing 16 is rigidly secured to a frame 27 (see FIG. 2), which is suspended to the vessel 5 so as to be pivotable about an axis 8. The upper tubing 16 communicates through bellows 28 with a pump 53 positioned in the vessel 5 for pumping on the suspension through a duct 41. The frame 27 and the rigid tubings 16 are furthermore suspended from the vessel 5 by means of cables 29 of hoisting devices 30 positioned on the vessel 5.

The closing member 14 is included in the suction duct 9 near the pump 10 and the closing part 17 of said member is movable under the action of a source of power, preferably a pneumatic spring 18, between an open position for supplementing water 3 into the suction duct 9 and the closed position shown in FIG. 3. This pneumatic spring 18 consists of a pressure chamber 19 bounded by a movable wall 20 having a membrane 21 and communicating through an inlet 22 with a pressure source 23 having a predetermined absolute pressure of, for example, 2 meters water column. It will be appreciated, of course, that this pressure will not be sufficient to open the valve part 17 at the ambient water pressure prevailing at that depth to which the device 14 is submerged in normal operation. The movable wall 20 also defines a pressure chamber 24 which is in communication with the suction duct 9 via the pump 10 by means of the duct 26 and the inlet 25. Therefore, pump inlet pressure in the pressure chamber 24 acts upon the movable wall 20 in a sense opposite the action exerted by the pneumatic spring 18 on the movable wall 20. The movable wall 20 is mechanically coupled with the closing part 17 of the closing member 14. The closing part 17 is preferably formed by a cylindrical slide 31, which is axially displaceable in bearings 32 and 33 and which can variably close the annular inlet gap 34 in accord with the pressure differential between the chambers 19 and 24.

Referring to FIG. 3 wherein the control member 14 is shown closed, the closing part 17 is in sealing relationship with a radial, stationary wall 36 by means of a rubber seal 35. The closing part 17 is balanced by its shape and bearing position so that it can be closed or opened by comparatively little power. Use is made of an equilibrium between the pressure on the suction side of the pump 10 and a predetermined pressure of the source 23, in which case the difference in pressure provides directly, that is to say without transmission ratio the required power for opening and closing respectively.

In order to safeguard a fluid transport in the hydraulic transport duct 2 in the method according to the invention even if the nozzle 11 should be wholly or partly clogged and/or if too much ground should be present in the suction duct 9 the closing member 14 is moved into the open position at a drop below the pressure on the suction side of the pump 10, that is to say at a drop below the predetermined pressure in the pressure chamber 19 so that water 3 is supplemented into the transport duct 2. At an excess pressure above the predetermined pressure the supplementation is stopped. Obviously, the predetermined pressure in the chamber 19 must be chosen to be greater than the lowest pressure which is to be permitted on the suction side of the pump. That is, since the valve member 17 will not even begin to move off its seat until the pressure in the chamber 24 has dropped below that in chamber 19, the pump must be capable of producing a lesser pressure at its suction side and, therefore, there must be some margin between the aforesaid lowest permitted pressure and that pressure existing in the chamber 19. It is precisely this relationship which renders the present invention advantageous over the prior art. To explain, it must be observed that the dredger operator is concerned to extract dredging spoil at a high rate. This means that the operator seeks to keep the pump operating at a suction pressure above but quite close to the lowest permitted pressure. Thus, with typical prior art devices, when a partial blockage in or above the suction nozzle occurs, the supplemental water valve slams open and stays open for some time, i.e., the supplemental water valve is either full open or closed. When the valve is full open, nothing but water passes through the pump and no dredger spoil is conveyed. However, with the present invention, the valve is progressively opened under the same circumstances, and may actually stabitlize at any partially opened condition. Also, the rate at which the member 17 is moved will vary dependent the operating condition. Thus, in the case of a total blockage, the pressure in the chamber 24 will drop to or near to the lowest permitted pressure and the pressure differential between the two chambers 24 and 19 will be at a maximum. The member 17 will therefore rapidly move to the full open position. However, if there is only a partial blockage or similar condition which causes the pump inlet pressure to drop to a value between the lowest permitted pressure and the pressure in the chamber 19, the valve 17 will slowly move toward open position and, in the process, will thus raise the pump inlet pressure. As noted, it can occur that an equilibrium condition is attained wherein the valve stops moving and remains in partially opened condition. It is also possible that the gradual opening movement of the valve and consequent pressure rise at the suction inlet of the pump will then close the valve, e.g., if the temporary blockage condition is transient or if the operator takes some corrective action. In this manner a state of equilibrium of the closing part 17 is attained such that exactly the amount of water 3 is supplemented which is required by the operational conditions. In other words, there is supplemented no larger amount of water 3 than is required for ensuring the transport in the transport duct 2. Thus the amount of ground transported can be large as compared with the amount of water 3 in the mixture. Briefly stated, the passage of the closing member 14 is enlarged and reduced as the pressure on the suction side of the pump 10 becomes lower and higher respectively. In order to avoid a rapid reciprocatory movement of the wall 20, this movement is preferably attenuated by means of a piston 36 of a hydraulic absorber 37 fastened to the wall 20.

The pressure chamber 24 has a small opening 54, through which a small amount of water 3 continuously trickles in so that the pressure chamber 24 and the connecting duct 26 are flushed clean.

In a further development of the device shown in FIG. 4 the damper 37 communicates through chokes 38 with the oil chamber 44 of a pressure compensator 42 having a membrane 43, which separates the oil chamber 44 from an air chamber 45. The air chamber 45 communicates through a duct 46 with the pressure chamber 19 in order to have low pressure in the air chamber 45. The extreme positions of the closing part 17 can be observed with the aid of electric tell-tale switches 47 and 48 actuated by stops 49 and 50 respectively of the wall 20 for remote-signalling of said positions. If in the event of a calamity, for example, a torn membrane 21, the closing member 14 remains in the open position, it can be remotely closed. For example it can be closed with the aid of a manual oil pump 51, which upon actuation automatically closes a flap 52 in the overflow damping circuit of the damper 37 and which energizes the damper 37 in the closing direction of the closing part 17. The damper 37 thus constitutes an additive motor for closing the closing part 17. The opening 54, which is larger in FIG. 4 than in FIG. 3, is provided with a flap 55 remote-controlled from the vessel 5 in order to flush the chamber 24 from time to time.

In embodiment shown in FIG. 5 the closing member 56 is formed by a butterfly flap 58 pivoting about a shaft 57 and is actuated by a piston 59 of a cylinder 60, which in itself is pivotable with respect to the suction duct 9 about a hinge 62. The piston 59 is a moving wall between the pressure chamber 24 and a pressure chamber 19 operating as a pneumatic spring, in which through a nipple 61 a predetermined pressure of, for example, 1,5 water column is produced. The pressure chamber 24 again communicates through a connecting duct 26 with the suction duct 9 so that at a pressure drop below the predetermined pressure in the suction duct 9, the butterfly valve 58 is moved into the controlled, preferably narrow, opened position. FIG. 5 shows the extreme open position.

What I claim is:

1. In a suction dredger system including a pump having an inlet and an outlet, suction conduit means connected to said inlet for sucking up a suspension of dredging spoil in water and spoil delivery conduit means connected to said outlet for conveying said suspension from the pump, the improvement which comprises:

valve means for bleeding supplemental water into the system adjacent to the inlet of said pump when the suction pressure at said inlet deviates from a preset pressure value; and actuating means responsive to the pressure at said inlet for progressively decreasing the amount of water supplemented by said valve means as the pressure at said inlet increases with respect to said preset value and for progressively increasing the amount of water supplemented by said valve means as the pressure at said inlet decreases with respect to said preset value, said actuating means comprising a chamber and a movable wall dividing said chamber into first and second compartments, means for subjecting one compartment to negative pressure less than said preset value and means for subjecting the other compartment to the pressure at said inlet of the pump.

2. In a suction dredger system including a pump having an inlet and an outlet, suction conduit means connected to said inlet for sucking up a suspension of dredging spoil in water and spoil delivery conduit means connected to said outlet for conveying said suspension from the pump, the improvement which comprises:

valve means for bleeding supplemental water into the system adjacent to the inlet of said pump when the suction pressure at said inlet deviates from a preset pressure, said valve means comprising an axially movable cylinder and an annular valve seat axially aligned with one end of said cylinder; and actuating means responsive to the pressure at said inlet for progressively decreasing the amount of water supplemented by said valve means as the pressure at said inlet increases with respect to said preset value and for progressively increasing the amount of water supplemented by said valve means as the pressure at said inlet decreases with respect to said preset value, said actuating means comprising a chamber and a movable wall connected with said cylinder for axial movement therewith and dividing said chamber into first and second compartments, means for subjecting one compartment to negative pressure less than said preset value and means for subjecting the other compartment to the pressure at said inlet of the pump.

3. In a suction dredger system including a pump having an inlet and an outlet, suction conduit means connected to said inlet for sucking up a suspension of dredging spoil in water and spoil delivery conduit means connected to said outlet for conveying said suspension from the pump, the improvement which comprises:

valve means for bleeding supplemental water into the system adjacent to the inlet of said pump when the suction pressure at said inlet deviates from a preset pressure, said valve means being of the butterfly type; and actuating means responsive to the pressure at said inlet for progressively decreasing the amount of water supplemented by said valve means as the pressure at said inlet increases with respect to said preset value and for progressively increasing the amount of water supplemented by said valve means as the pressure at said inlet decreases with respect to said preset value, said actuating means comprising a chamber and a movable wall dividing said chamber into first and second compartments, means for subjecting one compartment to negative pressure less than said preset value and means for subjecting the other compartment to the pressure at said inlet of the pump.

4. In a suction dredger as defined in in any one of claims 1, 2 or 3 wherein said negative pressure is in the order of 1.5–2.0 meters of water column.

* * * * *